US008607580B2

(12) United States Patent
Faka

(10) Patent No.: US 8,607,580 B2
(45) Date of Patent: Dec. 17, 2013

(54) REGASIFICATION OF LNG USING DEHUMIDIFIED AIR

(75) Inventor: Solomon Aladja Faka, Woodland Hills, CA (US)

(73) Assignee: Woodside Energy Ltd., Perth, Western Australia (AU)

( * ) Notice: Subject to any disclaimer, the term of this patent is extended or adjusted under 35 U.S.C. 154(b) by 1725 days.

(21) Appl. No.: 11/681,233

(22) Filed: Mar. 2, 2007

(65) Prior Publication Data

US 2007/0214807 A1 Sep. 20, 2007

Related U.S. Application Data

(63) Continuation-in-part of application No. PCT/IB2007/000383, filed on Feb. 19, 2007, and a continuation-in-part of application No. 11/559,144, filed on Nov. 13, 2006, now abandoned.

(60) Provisional application No. 60/782,282, filed on Mar. 15, 2006.

(51) Int. Cl.
*F17C 9/02* (2006.01)

(52) U.S. Cl.
USPC ..... 62/50.2; 62/48.1

(58) Field of Classification Search
USPC ..... 62/50.2, 48.1
See application file for complete search history.

(56) References Cited

U.S. PATENT DOCUMENTS

| | | | | |
|---|---|---|---|---|
| 1,699,542 | A | 1/1929 | Murray | |
| 1,874,578 | A | 8/1932 | Morrison | |
| 2,795,937 | A | 6/1957 | Sattler et al. | |
| 2,833,121 | A * | 5/1958 | Dorf | 62/50.2 |
| 2,903,860 | A | 9/1959 | Brown | |
| 2,938,359 | A | 5/1960 | Cobb et al. | |
| 2,940,268 | A | 6/1960 | Morrison | |
| 2,975,607 | A | 3/1961 | Bodle | |

(Continued)

FOREIGN PATENT DOCUMENTS

| | | | |
|---|---|---|---|
| DE | 2052154 A | 4/1972 | |
| DE | 3035349 | 4/1982 | |
| DE | 3338237 | 5/1985 | |
| EP | 0134690 A2 | 3/1985 | |
| EP | 306972 A1 * | 3/1989 | C09K 5/00 |
| GB | 2094461 | 9/1982 | |
| GB | 2143022 A | 1/1985 | |

(Continued)

OTHER PUBLICATIONS

Machine translation of JP 2001 304735.*

(Continued)

*Primary Examiner* — John Pettitt
(74) *Attorney, Agent, or Firm* — Edell, Shapiro & Finnan, LLC

(57) ABSTRACT

A process and apparatus for regasification of LNG to form natural gas using ambient air as the primary source of heat are described. LNG is directed to flow through an ambient air vaporizer to form a natural gas stream through direct heat exchange between the LNG and ambient air. The temperature of the natural gas stream is adjusted to suit a predetermined delivery temperature in a trim heater exchanging heat with a circulating intermediate fluid. The intermediate fluid is directed to flow through an ambient air heater such that the intermediate fluid exchanges heat with ambient air. Heat transfer between the ambient air and the LNG is assisted using one or more force draft fans to direct the flow of ambient air over the ambient air heater and the ambient air vaporizer in turn to dry the ambient air before it arrives at the ambient air vaporizer.

18 Claims, 3 Drawing Sheets

(56) References Cited

U.S. PATENT DOCUMENTS

| | | | | |
|---|---|---|---|---|
| 3,001,379 | A | 9/1961 | Fukuzawa et al. | |
| 3,058,317 | A * | 10/1962 | Putman | 62/50.2 |
| 3,154,928 | A | 11/1964 | Harmens | |
| 3,208,261 | A | 9/1965 | Pasternak | |
| 3,350,876 | A | 11/1967 | Johnson | |
| 3,365,898 | A | 1/1968 | Van Kleef | |
| 3,421,574 | A | 1/1969 | Kals | |
| 3,435,623 | A * | 4/1969 | Lewis, Jr | 62/50.2 |
| 3,438,216 | A | 4/1969 | Smith | |
| 3,590,407 | A | 7/1971 | Bratianu | |
| 3,720,057 | A | 3/1973 | Arenson | |
| 3,768,271 | A | 10/1973 | Denis | |
| 3,857,245 | A | 12/1974 | Jones | |
| 3,864,918 | A | 2/1975 | Lorenz | |
| 3,945,508 | A | 3/1976 | Colin | |
| 3,986,340 | A | 10/1976 | Bivins, Jr. | |
| 4,033,135 | A | 7/1977 | Mandrin | |
| 4,036,028 | A | 7/1977 | Mandrin | |
| 4,045,972 | A * | 9/1977 | Lewis, Jr. | 62/156 |
| 4,170,115 | A | 10/1979 | Ooka et al. | |
| 4,197,712 | A | 4/1980 | Zwick et al. | |
| 4,224,802 | A | 9/1980 | Ooka | |
| 4,231,226 | A | 11/1980 | Griepentrog | |
| 4,331,129 | A | 5/1982 | Hong et al. | |
| 4,399,660 | A | 8/1983 | Vogler, Jr. et al. | |
| 4,408,943 | A | 10/1983 | McTamaney et al. | |
| 4,417,878 | A | 11/1983 | Koren | |
| 4,420,942 | A | 12/1983 | Davis et al. | |
| 4,487,256 | A | 12/1984 | Lutjens et al. | |
| 4,519,213 | A | 5/1985 | Brigham et al. | |
| 4,813,632 | A | 3/1989 | Woodhouse | |
| 4,819,454 | A | 4/1989 | Brigham et al. | |
| 4,881,495 | A | 11/1989 | Tornare et al. | |
| 4,995,234 | A | 2/1991 | Kooy et al. | |
| 5,095,709 | A | 3/1992 | Billiot | |
| 5,099,779 | A | 3/1992 | Kawaichi et al. | |
| 5,129,848 | A | 7/1992 | Etheridge et al. | |
| 5,147,005 | A | 9/1992 | Haeggstrom | |
| 5,240,466 | A | 8/1993 | Bauer et al. | |
| 5,251,452 | A | 10/1993 | Wieder | |
| 5,292,271 | A | 3/1994 | Boatman et al. | |
| 5,295,350 | A | 3/1994 | Child et al. | |
| 5,306,186 | A | 4/1994 | Boatman | |
| 5,316,509 | A | 5/1994 | Boatman et al. | |
| 5,351,487 | A | 10/1994 | Abdelmalek | |
| 5,356,321 | A | 10/1994 | Boatman et al. | |
| 5,372,531 | A | 12/1994 | Boatman et al. | |
| 5,375,582 | A | 12/1994 | Wimer | |
| 5,394,686 | A | 3/1995 | Child et al. | |
| 5,400,588 | A | 3/1995 | Yamane et al. | |
| 5,456,622 | A | 10/1995 | Breivik et al. | |
| 5,457,951 | A | 10/1995 | Johnson et al. | |
| 5,492,075 | A | 2/1996 | Lerstad et al. | |
| 5,529,239 | A | 6/1996 | Anttila et al. | |
| 5,545,065 | A | 8/1996 | Breivik et al. | |
| 5,564,277 | A * | 10/1996 | Martin | 62/50.3 |
| 5,564,957 | A | 10/1996 | Breivik et al. | |
| 5,584,607 | A | 12/1996 | de Baan | |
| 5,727,492 | A | 3/1998 | Cuneo et al. | |
| 5,762,119 | A | 6/1998 | Platz et al. | |
| 5,819,542 | A | 10/1998 | Christiansen et al. | |
| 5,820,429 | A | 10/1998 | Smedal et al. | |
| 5,878,814 | A | 3/1999 | Breivik et al. | |
| 5,921,090 | A | 7/1999 | Jurewicz et al. | |
| 5,944,840 | A | 8/1999 | Lever | |
| 6,003,603 | A | 12/1999 | Breivik et al. | |
| 6,085,528 | A | 7/2000 | Woodall et al. | |
| 6,089,022 | A | 7/2000 | Zednik et al. | |
| 6,094,937 | A | 8/2000 | Paurola et al. | |
| 6,109,830 | A | 8/2000 | de Baan | |
| 6,221,276 | B1 * | 4/2001 | Sarin | 252/76 |
| 6,244,920 | B1 | 6/2001 | de Baan | |
| 6,263,818 | B1 | 7/2001 | Dietens et al. | |
| 6,298,671 | B1 | 10/2001 | Kennelley et al. | |
| 6,354,376 | B1 | 3/2002 | De Baan | |
| 6,367,258 | B1 | 4/2002 | Wen et al. | |
| 6,374,591 | B1 | 4/2002 | Johnson et al. | |
| 6,378,722 | B1 | 4/2002 | Dhellemmes | |
| 6,517,290 | B1 | 2/2003 | Poldervaart | |
| 6,546,739 | B2 | 4/2003 | Frimm et al. | |
| 6,571,548 | B1 | 6/2003 | Bronicki et al. | |
| 6,581,368 | B2 | 6/2003 | Utamura | |
| 6,598,401 | B1 | 7/2003 | Utamura | |
| 6,598,408 | B1 | 7/2003 | Nierenberg | |
| 6,609,360 | B2 | 8/2003 | Utamura | |
| 6,622,492 | B1 | 9/2003 | Eyermann | |
| 6,623,043 | B1 | 9/2003 | Pollack | |
| 6,637,479 | B1 | 10/2003 | Eide et al. | |
| 6,644,041 | B1 | 11/2003 | Eyermann | |
| 6,688,114 | B2 | 2/2004 | Nierenberg | |
| 6,692,192 | B2 | 2/2004 | Poldervaart | |
| 6,811,355 | B2 | 11/2004 | Poldervaart | |
| 6,889,522 | B2 | 5/2005 | Prible et al. | |
| 7,219,502 | B2 | 5/2007 | Nierenberg | |
| 7,287,389 | B2 | 10/2007 | Feger | |
| 7,293,600 | B2 | 11/2007 | Nierenberg | |
| 7,493,868 | B1 | 2/2009 | Arnal et al. | |
| 2002/0047267 | A1 | 4/2002 | Zimron et al. | |
| 2002/0073619 | A1 | 6/2002 | Perkins et al. | |
| 2002/0124575 | A1 | 9/2002 | Pant et al. | |
| 2002/0174662 | A1 | 11/2002 | Frimm et al. | |
| 2003/0005698 | A1 | 1/2003 | Keller | |
| 2003/0099517 | A1 | 5/2003 | Poldervaart | |
| 2003/0226487 | A1 | 12/2003 | Boatman | |
| 2004/0006966 | A1 * | 1/2004 | Hallman et al. | 60/39.093 |
| 2004/0025772 | A1 | 2/2004 | Boatman | |
| 2004/0094082 | A1 | 5/2004 | Boatman et al. | |
| 2004/0182090 | A1 | 9/2004 | Feger | |
| 2005/0061002 | A1 | 3/2005 | Nierenberg | |
| 2005/0120723 | A1 | 6/2005 | Baudat | |
| 2005/0217314 | A1 | 10/2005 | Baudat | |
| 2005/0274126 | A1 | 12/2005 | Baudat | |
| 2006/0010911 | A1 | 1/2006 | Hubbard et al. | |
| 2006/0053806 | A1 | 3/2006 | Tassel | |
| 2006/0075762 | A1 | 4/2006 | Wijngaarden et al. | |
| 2006/0180231 | A1 | 8/2006 | Harland et al. | |
| 2006/0231155 | A1 | 10/2006 | Harland et al. | |
| 2007/0074786 | A1 | 4/2007 | Adkins et al. | |
| 2007/0095427 | A1 | 5/2007 | Ehrhardt et al. | |
| 2007/0289517 | A1 | 12/2007 | Poldervaart et al. | |

FOREIGN PATENT DOCUMENTS

| | | | | |
|---|---|---|---|---|
| JP | 53126003 | | 11/1978 | |
| JP | 54008242 | | 1/1979 | |
| JP | 58113699 | | 7/1983 | |
| JP | 59179477 | A | 10/1984 | |
| JP | 63203995 | A | 8/1988 | |
| JP | 63203996 | A | 8/1988 | |
| JP | 370696 | A | 3/1991 | |
| JP | 58788 | A | 1/1993 | |
| JP | 11294694 | A | 10/1999 | |
| JP | 2001304735 | A * | 10/2001 | F25D 3/10 |
| JP | 2002340296 | A | 11/2002 | |
| JP | 2003074793 | A | 3/2003 | |
| JP | 2003148845 | A | 5/2003 | |
| JP | 200451050 | A | 2/2004 | |
| JP | 2006029356 | A * | 2/2006 | |
| JP | 2005098480 | | 10/2006 | |
| WO | 0103793 | A1 | 1/2001 | |
| WO | 02076819 | A1 | 10/2002 | |
| WO | 03053774 | A1 | 7/2003 | |
| WO | 03085317 | A1 | 10/2003 | |
| WO | 2005056377 | A2 | 6/2005 | |
| WO | 2005110016 | A2 | 11/2005 | |
| WO | 2006030316 | A2 | 3/2006 | |
| WO | WO 2006068832 | A1 * | 6/2006 | |
| WO | 2006088371 | A1 | 8/2006 | |

OTHER PUBLICATIONS

Stone, et al. "Offshore LNG Loading Problem Solved", Gastech, 2000.

(56) References Cited

OTHER PUBLICATIONS

Larsen, et al. "SRV, The LNG Shuttle and Regas Vessel System", Offshore Technology Conference 16580, Houston, May 2004.
FERC Publication, "Draft Environmental Impact Statement for Dominion Cove Point LNG . . . ", Chapter 23, p. 3-6 Oct. 2005.
EXCELERATE, LLC "Breaking the Traditional Model—Bringing Continents of Energy Together, Energy Bridge", CWC Sixth Annual World LNG Summit Rome 2005, Nov. 2005.
HOEGH LNG, "Future Technological Challenges in LNG Shipping", LNG Journal, Norshipping, 2005.
Cook, J.W., "Special Session: Energy Bridge LNG Projects: Gulf Gateway Energy Bridge—The First Year of Operations and the Commercial and Operational Advantages of the Energy Bridge Technology", Offshore Technology Conference 18396, Houston, May, 2006.
Worthington, W.S. and B.S. Hubbard, "Improved Regasification Methods Reduce Emissions", Hydrocarbon Processing, Gulf Publishing co., pp. 51-54, HydrocarbonProcessing.com, Jul. 2005.
Lane, Mark, "Energy Bridge Maximizing Utilization," presented to the United States Coast Guard, Port Arthur, TX, Jun. 16, 2005.
Excelerate Energy Limited Partnership, "Lessons Learned from Permitting, Building, and Operating the Gulf Gateway Energy Bridge Deepwater Port," Oil & Gas IQ Conference, LNG Terminals: Sitting, Permitting, and Financing a Successful LNG Project, Costa Mesa, CA, Sep. 14, 2005.
Bryngelson, Rob, "Excelerate Energy Northeast Gateway and Gulf Gateway Deepwater Port Update," Northeast Energy and Commerce Association, 11th Annual Conference on Natural Gas Issues, Boston, MA, Sep. 19, 2005.
Cook, Jonathan & Lane, Mark, "LNG Ship-to-Ship Transfer," SIGTTO, Houston, TX, Nov. 18, 2005.
Excelerate Energy Limited Partnership, "Liquefied Natural Gas Storage and Transport for Russia," presented to the U.S. Department of Commerce SABIT Group Program, The Woodlands, Texas, Aug. 31, 2006.
Excelerate Energy. "Development Information." www.excelerateenergy.com (Nov. 30, 2005): 1-3.
Excelerate Energy. "Energy Bridge Regasification Vessels." www.excelerateenergy.com (Nov. 30, 2005): 1.
Zubiate et al. "Single point mooring system for floating LNG plant", Ocean Industry,Nov. 1978, pp. 75, 77, and 78.
Campbell et al. "Shipboard Regasification Terminal", proceedings of the Seventy-Eighth GPA Annual Convention (1999) pp. 295-298.
Van Tassel, Gary W. "An Economic System for the Liquefaction, Transportation, and Regas of Natural Gas using Surplus LNG Carriers", International Marine Symposium, NewYork 1984, pp. 171-177.
Avidan, A.A. "Innovative Solutions to Lower LNG Import Terminal Costs for Emerging LNG markets", presented at Gastech Nov. 29, 1998-Dec. 2, 1998.
Boylston, John W. "Concept Proposal for the Transportation and Regasification of Liquid Natural Gas", Argent Marine Operations, Inc., published 1996.
Rajabi et al. "The Heidrun Field: Oil Offtake System", OTC 8102, Offshore Technology Conference, May 6-9, 1996.
"High purity, high flow rate vaporization presents a system challenge for Cryoquip engineers", Frostbite Newsletter from Cryogenic Industries, vol. 12, No. 1, Spring 2002.
"Cryoquip engineers a unique heat exchanger with very high thermal efficiency", Frostbite Newsletter from Cryogenic Industries, vol. 13, No. 3, Spring 2003.
"Vaporizer ice build-up requires an analysis of switching issues for ambient air units", Frostbite Newsletter from Cryogenic Industries, vol. 8, No. 2, Winter 1996.
"Sub-Zero pumps achieve 85% efficiency levels", Frostbite Newsletter from Cryogenic Industries, vol. 9, No. 1, Spring 1998.
"LNG Receiving Terminal At Dahej, Gujarat, India", Paper Sessions, Thirteenth International Conference & Exhibition on Liquefied Natural Gas, Seoul, Korea, May 14-17, 2001.
Translation of JP Official Action received in Japanese Application No. 2008-558920, Mailed Feb. 3, 2012, (3 pages).
H. Werner, "The Flexible Solution—I.M. Skaugen's Fleet of Small Scale LNG Carriers", IMS—Innovative Maritime Solutions, Oslo 2007, pp. 1-22.

* cited by examiner

REGASIFICATION OF LNG USING DEHUMIDIFIED AIR

CROSS-REFERENCE TO RELATED APPLICATIONS

This application is a continuation-in-part of International Patent Application No. PCT/IB2007/000383, filed Feb. 19, 2007, and further is a continuation-in-part of U.S. patent application Ser. No. 11/559,144, filed Nov. 13, 2006, which claims priority from U.S. Provisional Application Ser. No. 60/782,282, filed on Mar. 15, 2006. The disclosures of the above-identified patent applications are incorporated herein by reference in their entireties.

FIELD OF THE INVENTION

The present invention relates to a method and apparatus for regasification of liquefied natural gas ("LNG") which relies on ambient air as the primary source of heat for vaporization. Ambient air exchanges heat with the LNG directly or indirectly through the use of an intermediate fluid.

BACKGROUND TO THE INVENTION

Natural gas is the cleanest burning fossil fuel as it produces less emissions and pollutants than either coal or oil. Natural gas ("NG") is routinely transported from one location to another location in its liquid state as "Liquefied Natural Gas ("LNG"). Liquefaction of the natural gas makes it more economical to transport as LNG occupies only about 1/600th of the volume that the same amount of natural gas does in its gaseous state. Transportation of LNG from one location to another is most commonly achieved using double-hulled ocean-going vessels with cryogenic storage capability referred to as "LNGCs". LNG is typically stored in cryogenic storage tanks onboard the LNGC, the storage tanks being operated either at or slightly above atmospheric pressure. The majority of existing LNGCs have an LNG cargo storage capacity in the size range of 120,000 $m^3$ to 150,000 $m^3$, with some LNGCs having a storage capacity of up to 264,000 $m^3$.

LNG is normally regasified to natural gas before distribution to end users through a pipeline or other distribution network at a temperature and pressure that meets the delivery requirements of the end users. Regasification of the LNG is most commonly achieved by raising the temperature of the LNG above the LNG boiling point for a given pressure. It is common for an LNGC to receive its cargo of LNG at an "export terminal" located in one country and then sail across the ocean to deliver its cargo at an "import terminal" located in another country. Upon arrival at the import terminal, the LNGC traditionally berths at a pier or jetty and offloads the LNG as a liquid to an onshore storage and regasification facility located at the import terminal. The onshore regasification facility typically comprises a plurality of heaters or vaporizers, pumps and compressors. Such onshore storage and regasification facilities are typically large and the costs associated with building and operating such facilities are significant.

Regasification of LNG is generally conducted using one of the following three types of vaporizers: an open rack type, an intermediate fluid type or a submerged combustion type.

Open rack type vaporizers typically use sea water as a heat source for the vaporization of LNG. These vaporizers use once-through seawater flow on the outside of a heater as the source of heat for the vaporization. They do not block up from freezing water, are easy to operate and maintain, but they are expensive to build. They are widely used in Japan. Their use in the USA and Europe is limited and economically difficult to justify for several reasons. First the present permitting environment does not allow returning the seawater to the sea at a very cold temperature because of environmental concerns for marine life. Also coastal waters like those of the southern USA are often not clean and contain a lot of suspended solids, which could require filtration. With these restraints the use of open rack type vaporizers in the USA is environmentally and economically not feasible.

Instead of vaporizing liquefied natural gas by direct heating with water or steam, vaporizers of the intermediate fluid type use propane, fluorinated hydrocarbons or like refrigerant having a low freezing point. The refrigerant is heated with hot water or steam first to utilize the evaporation and condensation of the refrigerant for the vaporization of liquefied natural gas. Vaporizers of this type are less expensive to build than those of the open rack-type but require heating means, such as a burner, for the preparation of hot water or steam and are therefore costly to operate due to fuel consumption.

Vaporizers of the submerged combustion type comprise a tube immersed in water which is heated with a combustion gas injected thereinto from a burner. Like the intermediate fluid type, the vaporizers of the submerged combustion type involve a fuel cost and are expensive to operate. Evaporators of the submerged combustion type comprise a water bath in which the flue gas tube of a gas burner is installed as well as the exchanger tube bundle for the vaporization of the liquefied natural gas. The gas burner discharges the combustion flue gases into the water bath, which heat the water and provide the heat for the vaporization of the liquefied natural gas. The liquefied natural gas flows through the tube bundle. Evaporators of this type are reliable and of compact size, but they involve the use of fuel gas and thus are expensive to operate.

It is known to use ambient air or "atmospheric" vaporizers to vaporize a cryogenic liquid into gaseous form for certain downstream operations.

For example, U.S. Pat. No. 4,399,660, issued on Aug. 23, 1983 to Vogler, Jr. et al., describes an ambient air vaporizer suitable for vaporizing cryogenic liquids on a continuous basis. This device employs heat absorbed from the ambient air. At least three substantially vertical passes are piped together. Each pass includes a center tube with a plurality of fins substantially equally spaced around the tube.

U.S. Pat. No. 5,251,452, issued on Oct. 12, 1993 to L. Z. Widder, discloses an ambient air vaporizer and heater for cryogenic liquids. This apparatus utilizes a plurality of vertically mounted and parallelly connected heat exchange tubes. Each tube has a plurality of external fins and a plurality of internal peripheral passageways symmetrically arranged in fluid communication with a central opening. A solid bar extends within the central opening for a predetermined length of each tube to increase the rate of heat transfer between the cryogenic fluid in its vapor phase and the ambient air. The fluid is raised from its boiling point at the bottom of the tubes to a temperature at the top suitable for manufacturing and other operations.

U.S. Pat. No. 6,622,492, issued Sep. 23, 2003, to Eyermann, discloses apparatus and process for vaporizing liquefied natural gas including the extraction of heat from ambient air to heat circulating water. The heat exchange process includes a heater for the vaporization of liquefied natural gas, a circulating water system, and a water tower extracting heat from the ambient air to heat the circulating water.

U.S. Pat. No. 6,644,041, issued Nov. 11, 2003 to Eyermann, discloses a process for vaporizing liquefied natural gas including passing water into a water tower so as to elevate a temperature of the water, pumping the elevated temperature water through a first heater, passing a circulating fluid through the first heater so as to transfer heat from the elevated temperature water into the circulating fluid, passing the liquefied natural gas into a second heater, pumping the heated circulating fluid from the first heater into the second heater so as to transfer heat from the circulating fluid to the liquefied natural gas, and discharging vaporized natural gas from the second heater.

Atmospheric vaporizers are not generally used for continuous service because ice and frost build up on the outside surfaces of the atmospheric vaporizer, rendering the unit inefficient after a sustained period of use. The rate of accumulation of ice on the external fins depends in part on the differential in temperature between ambient temperature and the temperature of the cryogenic liquid inside of the tube. Typically the largest portion of the ice packs tends to form on the tubes closest to the inlet, with little, if any, ice accumulating on the tubes near the outlet unless the ambient temperature is near or below freezing. It is therefore not uncommon for an ambient air vaporizer to have an uneven distribution of ice over the tubes which can shift the centre of gravity of the unit and which result in differential thermal gradients between the tubes.

In spite of the advancements of the prior art, there is still a need in the art for improved apparatus and methods for regasification of LNG using ambient air as the primary source of heat.

SUMMARY OF THE INVENTION

According to one aspect of the present invention there is provided a process for regasification of LNG to form natural gas using ambient air as the primary source of heat, said process comprising the steps of:

(a) directing LNG to flow through an ambient air vaporizer to form a natural gas stream through direct heat exchange between the LNG and ambient air;

(b) adjusting the temperature of the natural gas stream to a predetermined delivery temperature in a trim heater by exchanging heat with a circulating intermediate fluid;

(c) directing the intermediate fluid to flow through an ambient air heater such that the intermediate fluid exchanges heat with ambient air; and, (d) assisting heat transfer using one or more force draft fans to direct the flow of ambient air over the ambient air heater and the ambient air vaporizer, the ambient air heater being arranged in closer proximity to the forced draft fans than the ambient air vaporizer such that the air is directed to flow across the ambient air heater to cool and dry the air before the air arrives at the ambient air vaporizer.

In one embodiment, the one or more forced draft fans are installed above the ambient air heater which in turn is installed above the ambient air vaporizer and the air is caused to flow downwardly across the ambient air heater before arriving at the ambient air vaporizer. To reduce the overall size of the regasification facility, the ambient air heater and the ambient air vaporizer may be arranged as a single system and share a common forced draft fan.

To avoid icing on the ambient air heater, the temperature of the intermediate fluid may be maintained above zero degrees Celsius so that the ambient air heater may comprise a horizontal tube bundle. In one embodiment, the ambient air heater comprises a horizontal tube bundle and the ambient air vaporizer comprises a vertical tube bundle. The temperature of the intermediate fluid may be maintained above zero degrees Celcius using a source of supplemental heat. The source of supplemental heat may be selected from the group consisting of: an exhaust gas heater; an electric water or fluid heater; a propulsion unit of a ship; a diesel engine; or a gas turbine propulsion plant; or an exhaust gas stream from a power generation plant.

In one embodiment, the process further comprises the step of directing a bypass stream of LNG to flow through an intermediate fluid vaporizer wherein the LNG exchanges heat with a portion of the circulating intermediate fluid.

The intermediate fluid may be selected from the list consisting of: a glycol, a glycol-water mixture, methanol, propanol, propane, butane, ammonia, a formate, fresh water or tempered water.

According to a second aspect of the present invention there is provided a regasification facility for regasification of LNG to form natural gas using ambient air as the primary source of heat, said apparatus comprising:

an ambient air vaporizer for regasifying LNG to natural gas;

a trim heater for boosting the temperature of the natural gas by exchanging heat with a circulating intermediate fluid;

an ambient air heater for heating the intermediate fluid;

a circulating pump for circulating the intermediate fluid between the trim heater and the ambient air heater; and, one or more forced draft fans for directing the flow of ambient air over the ambient air heater and the ambient air vaporizer, the ambient air heater being arranged in closer proximity to the forced draft fans than the ambient air vaporizer such that the air is directed to flow across the ambient air heater to cool and dry the air before the air arrives at the ambient air vaporizer.

In one embodiment, the ambient air heater is installed above the ambient air vaporizer in closer proximity to the forced draft fans such that the air is caused to flow downwardly across the ambient air heater before arriving at the ambient air vaporizer.

The ambient air heater may comprise a horizontal tube bundle and the ambient air vaporizer may comprise a vertical tube bundle.

Advantageously, icing of the ambient air heater can be avoided using a control device for regulating the temperature of the intermediate fluid fed to the ambient air heater to a temperature greater than zero degrees Celsius using a source of supplemental heat and the ambient air heater comprises a horizontal tube bundle. The source of supplemental heat may be selected from the list consisting of: an exhaust gas heater; an electric water or fluid heater; a propulsion unit of a ship; a fired heater; a diesel engine; or a gas turbine propulsion plant; or an exhaust gas stream from a power generation plant.

When the regasification facility is provided onboard an LNG carrier, the source of supplementary heat may be heat recovered from the engines of the LNG carrier.

In one embodiment, the apparatus further comprises an intermediate fluid vaporizer for vaporizing a bypass stream of LNG wherein the LNG exchanges heat with a portion of the circulating intermediate fluid.

BRIEF DESCRIPTION OF THE DRAWINGS

In order to facilitate a more detailed understanding of the nature of the invention several embodiments of the present invention will now be described in detail, by way of example only, with reference to the accompanying drawings, in which.

DETAILED DESCRIPTION OF PREFERRED EMBODIMENTS

Figure 1:
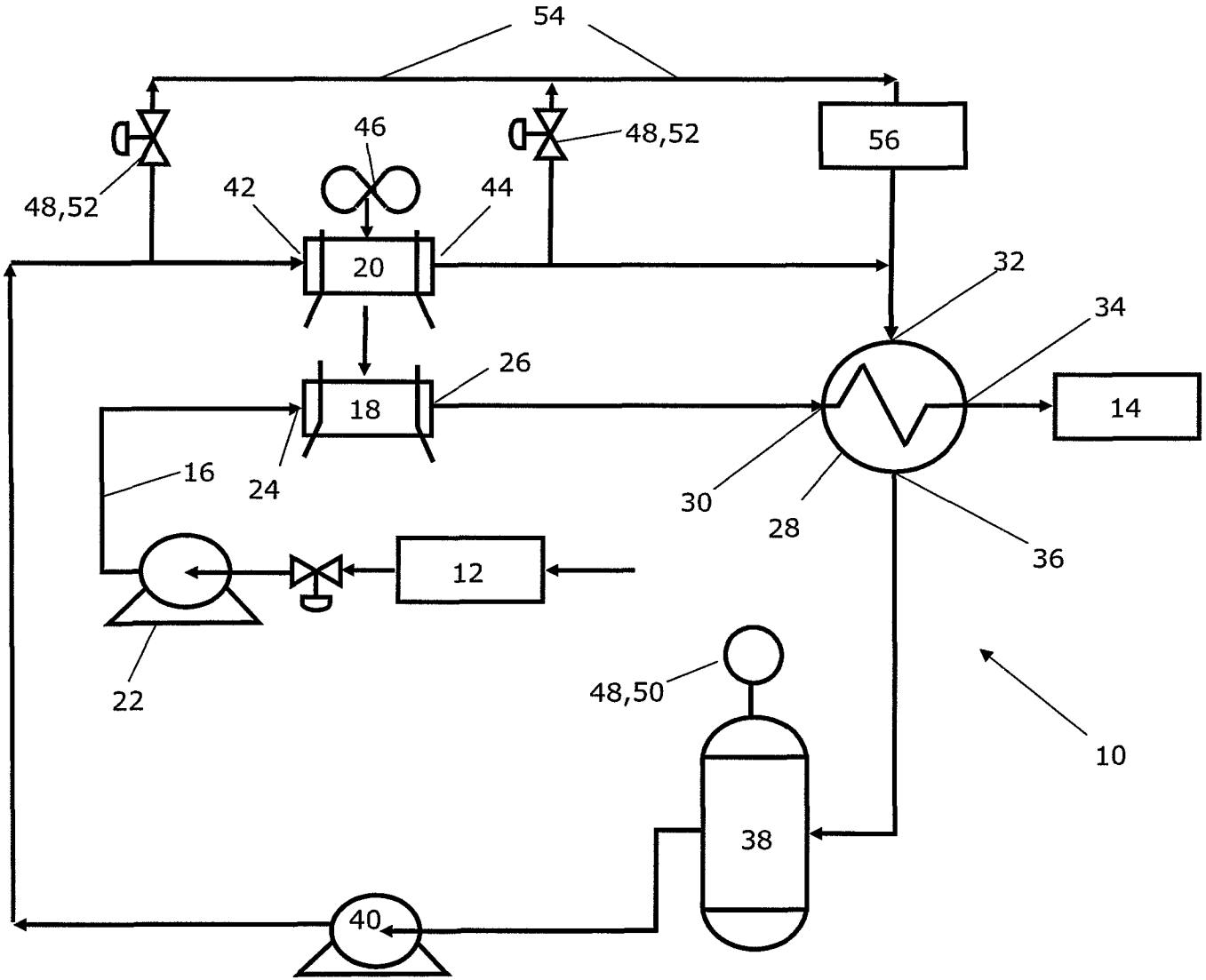
FIG. 1 is a flow chart illustrating a first embodiment of the regasification facility.

Particular embodiments of the method and apparatus for regasification of LNG using ambient air as the primary source of heat for vaporization are now described. The present invention is applicable to use for an onshore regasification facility or for use offshore on a fixed platform or barge or an LNG Carrier provided an onboard regasification facility. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs. In the drawings, it should be understood that like reference numbers refer to like members.

The term "vaporizer" refers to a device which is used to convert a liquid into a gas.

The term "drying" refers to a reduction in the amount of moisture present. In the context of this specification, when reference is made to the ambient air being dried, this should not be taken to mean that the moisture content has been reduced to zero, rather only that there is less moisture present in the air after drying than was present prior to drying.

A first embodiment of the system of the present invention is now described with reference to FIG. 1. In this first embodiment, a regasification facility 10 is used to regasify LNG that is stored in one or more cryogenic storage tanks 12 using ambient air as the primary source of heat for regasification of the LNG. The natural gas produced using the regasification facility 10 is transferred to a pipeline 14 for delivery of the natural gas to a gas distribution facility (not shown). The regasification facility 10 includes at least one ambient air vaporizer 18 for regasifying LNG to natural gas and at least one ambient air heater 20 for heating a circulating intermediate fluid used to boost the temperature of the natural gas to a predetermined delivery temperature.

Ambient air is used as both the primary source of heat for vaporization of the LNG to form natural gas as well as the means by which the temperature of the natural gas so produced is boosted to meet delivery requirements. Ambient air is used (instead of heat from burning of fuel gas) as the primary source of heat for regasification of the LNG to keep emissions of nitrous oxide, sulphur dioxide, carbon dioxide, volatile organic compounds and particulate matter to a minimum.

In the ambient air vaporizer 18, heat is transferred to the LNG from the ambient air by virtue of the temperature differential between the ambient air and the LNG. As a result, the ambient air is cooled, moisture in the air condenses, and the latent heat of condensation provides an additional source of heat for vaporization in addition to the sensible heat from the air. The condensed water that forms on the external surfaces of the ambient air vaporizer 18 runs off under gravity towards the lower half of the ambient air vaporizer 18 where it freezes on the external surfaces of the vaporizer 18 and ice is formed. The extent of icing on the external surfaces of the ambient air vaporizer 18 depends on a number of factors and can vary from about the lower half to the full height the external surface of the ambient air vaporiser 18. It is thus preferable that the ambient air vaporizer 18 is capable of withstanding the forces generated when ice is allowed to form on the external surfaces of thereof and in this regards, a vertical tube bundle is preferred to the use of a horizontal tube bundle. If ice starts to build up on the external surfaces of the ambient air vaporizer 18, the efficiency will drop and so will the temperature of the natural gas which exits the vaporizer 18.

The rate and degree of icing which occurs depends on a number of relevant factors including but not limited to the temperature and relative humidity of the ambient air, the flow rate of the LNG through the ambient air vaporizer 18, and the materials of construction of the ambient air vaporizer 18. The temperature and relative humidity of the ambient air can vary according to the seasons or the type of climate in the location at which regasification is conducted.

Using the process and apparatus of the present invention, heat transfer between the ambient air and the LNG and/or between the ambient air and the circulating intermediate fluid is assisted through the use of one or more forced draft fans 46. The ambient air heater 20 operates at a higher design temperature than the ambient air vaporizer 18 at all times. To take advantage of this, the ambient air heater 20 is located in closer proximity to the forced draft fans 46 such that the air is caused to flow through the ambient air heater 20 before arriving at the ambient air vaporizer 18.

In one particularly preferred arrangement, the ambient air heater 20 is installed above the ambient air vaporizer 18 in closer proximity to the forced draft fans 46 which in turn are installed above the ambient air heater and the air is caused to flow downwardly across the ambient air heater 20 before arriving at the ambient air vaporizer 18. It is to be understood that the ambient air heater 20 and the ambient air vaporizer 18 can take the form of two separate devices or can be integrated as two components of a single device to save space. Integrating the ambient air vaporizer 18 and the ambient air heater 20 such that they are arranged as a single system and share a common forced draft fan 46 has a number of advantages. One of the advantages is a reduction in the number of ambient air heaters 20 required to achieve a desired regasification capacity compared with conventional regasification facilities. This allows for a reduction in the size of the overall footprint of the regasification facility 10 making it particularly suitable for use onboard an LNG Carrier.

As the ambient air thus exchanges heat with the intermediate fluid flowing through the ambient air heater 20, the intermediate fluid temperature increases and the ambient air is cooled before the ambient air arrives at the ambient air vaporizer 18. The reduction in the temperature of the ambient air before it reaches the ambient air vaporizer 18 can be tolerated because the temperature of the LNG is much lower than the temperature of the circulating intermediate fluid. Another key advantage is that water condenses out of the ambient air as it flows over and exchanges heat with the ambient air heater 20 before it reaches the ambient air vaporizer 18. Drying the ambient air in this manner reduces the degree of icing which would otherwise occur on the external surfaces of the ambient air vaporizer 18, allowing the ambient air vaporizer 18 to operate at greater efficiency and to have greater availability as less down-time for defrosting is required.

Figure 2:
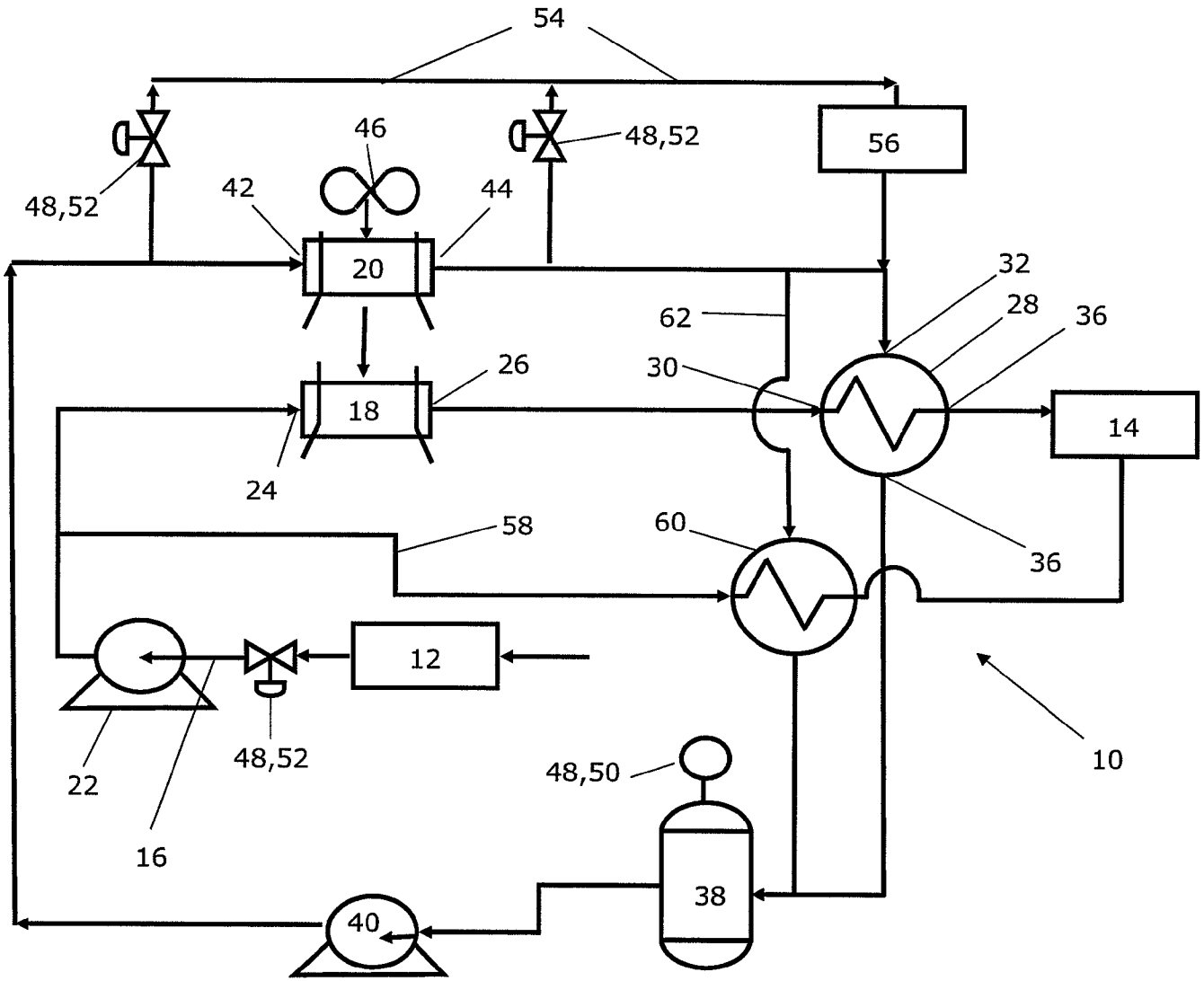
FIG. 2 is a flow chart illustrating a second embodiment of the regasification facility; and, FIG. 3 is a flow chart illustrating an alternative embodiment of FIG. 1 for use in extremely cold weather conditions.
Figure 3:
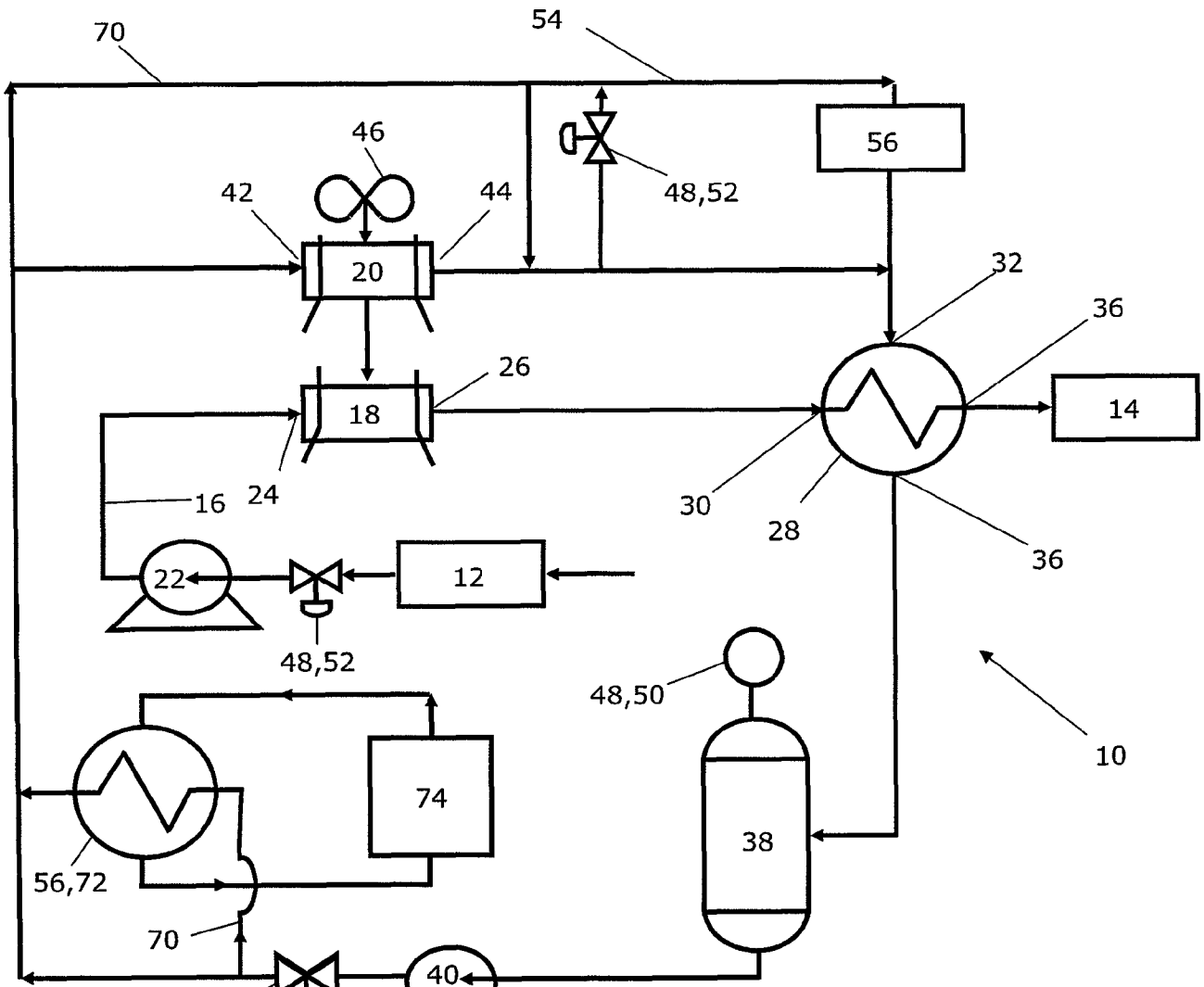

In the embodiments illustrated in FIGS. 1 to 3, Icing of the ambient air heater 20 is avoided by maintaining the temperature of the intermediate fluid directed to flow through the ambient air heater 20 above 0° C. at all times to avoid icing of the ambient air heater 20. When this is done, the ambient air heater 20 comprises a horizontal tube bundle (of the type used for a conventional horizontal fin fan heater), whilst the ambient air vaporizer 18 comprises a vertical tube bundle which is capable of operation under icing conditions.

The operation of the ambient air vaporizer 18 is now described in detail. A high pressure piping system 16 is used to convey LNG from a cryogenic storage tank 12 to the ambient air vaporizer 18 using a cryogenic send-out pump 22. The LNG is conveyed to the tube-side inlet 24 of the ambient air vaporizer 18. In the ambient air vaporizer 18, the ambient air exchanges heat directly with the LNG so as to vaporize the LNG to natural gas. After the LNG has been vaporized in the tubes, it leaves the tube-side outlet 26 of the ambient air vaporizer 18 as natural gas.

To provide sufficient surface area for heat exchange, the ambient air vaporizer 18 may be one of a plurality of vaporizers arranged in a variety of configurations, for example in series, in parallel or in banks. The ambient air vaporizer 18 can be any heat exchanger commonly known by those skilled in the art that is capable of withstanding the load applied when icing occurs and which meets the temperature, volumetric and heat absorption requirements for quantity of LNG to be regasified. In this regard, a heat exchanger comprising a vertically arranged tube bundle is preferred to a heat exchanger comprising a horizontally arranged tube bundle.

Depending on the prevailing ambient air temperature or if it is desired to reduce the number of ambient air vaporizers 18, the temperature of the natural gas which exits the tube-side outlet 26 of the vaporizer 18 can be as low as the vaporization temperature of LNG. The temperature of the natural gas which exits the tube-side outlet 26 of the vaporizer 18 can be as low as −40° C. or as high as the predetermined delivery temperature if the ambient temperature is high enough. If the natural gas which exits the tube-side outlet 26 of the vaporizer 18 is not already at the predetermined delivery temperature, a trim heater 28 arranged to exchange heat with a circulating intermediate heat transfer fluid is used to boost the temperature of the natural gas to meet delivery specifications. The predetermined delivery temperature is usually around 0° C. to 10° C. but could be higher depending on pipeline delivery requirements. If the temperature of the natural gas which exits the tube-side outlet 26 of the ambient air vaporizer 18 is above the predetermined delivery temperature, some or all of the forced draft fans 46 can be turned off to reduce the rate of heat transferred to the LNG by the ambient air and to minimize power consumption. The operation of the trim heater 28 is now described. The natural gas which exits the tube-side outlet 26 of the vaporizer 18 is directed to flow through the tube-side inlet 30 of the trim heater 28. Warm intermediate fluid is directed to flow through the shell-side inlet 32 of the trim heater 28 to heat the natural gas to the predetermined delivery temperature. The warmed natural gas exits the trim heater 28 through the tube-side outlet 34 for delivery into the pipeline 14. In the process of exchanging heat with the natural gas, the intermediate fluid is cooled before it exits the shell-side outlet 36 of the trim heater 28.

The cold intermediate fluid which leaves the shell-side outlet 36 of the trim heater 28 is directed via the surge tank 38 to the ambient air heater 20 using a circulating pump 40. The cold intermediate fluid is directed to flow into the tube-side inlet 42 of the of the ambient air heater 20, with ambient air acting on the external surfaces thereof to warm the intermediate fluid. Heat is transferred to the intermediate fluid from the ambient air as a function of the temperature differential between the ambient air and the temperature of the cold intermediate fluid which enters the tube-side inlet 42 of the ambient air heater 20. Heat transfer between the ambient air and the intermediate fluid is assisted through the use of one or more forced draft fans 46 arranged to direct the flow of air towards the ambient air heater 20.

Warm intermediate fluid exits the ambient air heater 20 through the tube-side outlet 44 and this warm intermediate fluid is circulated back to the shell-side inlet 32 of the trim heater 28 to boost the temperature of the natural gas passing through the tubes thereof as described above.

If the ambient temperature drops below a predetermined design average ambient temperature, the temperature of the natural gas which exits the ambient air vaporizer 18 and the temperature of the circulating intermediate fluid which exits the trim heater 28 will drop. A control device 48 in the form of a temperature sensor 50 and control valve 52 is used to ensure that the intermediate fluid being directed to flow into the tube-side inlet 42 of the ambient air heater 20 is maintained at a temperature of at least 0° C. at all times so that icing of the ambient air heater 20 is avoided.

The temperature sensor 50 measures the temperature of the circulating intermediate fluid in the surge tank 38. If the temperature of the intermediate fluid in the surge tank 38 is at or below 0° C., the control device 48 generates a signal to the control valve 52 which directs a bypass stream 54 of intermediate fluid to flow through a source of supplemental heat 56 instead of allowing the intermediate fluid to pass through the ambient air heater 20 from icing. The source of supplemental heat 56 can equally be used to boost the temperature of the circulating intermediate fluid to a required return temperature before the intermediate fluid enters the shell-side inlet 32 of the trim heater 28. When the ambient air temperature is sufficiently high (for example during the summer months), such that the ambient air is able to supply sufficient heat to maintain the temperature of the circulating intermediate fluid above 0° C. at all times, the source of supplementary heat 56 can be shut down.

In very cold climates where the ambient temperature is below 0° C. for long periods of time, the embodiment illustrated in FIG. 3 is used, for which like reference numerals refer to like parts. This embodiment is similar to the embodiment illustrated in FIG. 1, the main difference being that a bypass stream 70 of intermediate fluid from the surge tank 38 is directed to flow through a source of supplemental heat 56 in the form of a supplementary heat exchanger 72 to boost the temperature of the intermediate fluid before it is returned to shell-side inlet 32 of the trim heater 28. The bypass stream 70 is directed to pass through the tubes of the supplementary heat exchanger 72 within which it exchanges heat with an auxiliary intermediate heat transfer fluid (such as fresh water, tempered water, glycol or a mixture thereof which in turn is heated by a fired heater 74. Under these conditions, the ambient air heater 20 performs no duty until the ambient air temperature increases above 0° C.

In the embodiment of FIG. 2 for which like reference numerals refer to like parts, the bulk of the LNG is caused to flow through the ambient air vaporizer 18 in the manner described above in relation to the embodiment illustrated in FIG. 1. The main difference between this embodiment and the one illustrated in FIG. 1 is that the control device 48 is arranged to direct a bypass stream 58 of LNG through an intermediate fluid vaporizer 60 arranged to exchange heat between the bypass stream of LNG 58 and a portion 62 of the circulating intermediate fluid which has been warmed by the ambient air heater 20.

The benefit of this arrangement is that it reduces the load on the ambient air vaporizer 18 and provides for more efficient energy integration. The control device 48 in this embodiment is responsive to the temperature of the natural gas which leaves the ambient air vaporizer 18. If this temperature is below the predetermined delivery temperature, the control device 48 is used to reduce the flow rate of the LNG being sent to the ambient air vaporizer 18 and directs a portion thereof to the bypass stream 58 to the intermediate fluid vaporizer 60 instead. The relative percentage of LNG directed to the bypass stream 58 which flows through the intermediate fluid vaporizer 60 is thus a function of the ambient air temperature.

Suitable intermediate fluids for use in the process and apparatus of the present invention are selected from the group consisting of: glycol (such as ethylene glycol, diethylene glycol, triethylene glycol, or a mixture of them), glycol-water mixtures, methanol, propanol, propane, butane, ammonia, formate, tempered water or fresh water or any other fluid with an acceptable heat capacity, freezing and boiling points that is commonly known to a person skilled in the art. It is desirable to use an environmentally more acceptable material than glycol for the intermediate fluid. In this regard, it is preferable to use an intermediate fluid which comprises a solution containing an alkali metal formate, such as potassium formate or sodium formate in water or an aqueous solution of ammonium formate. Alternatively or additionally, an alkali metal acetate such as potassium acetate, or ammonium acetate may be used. The solutions may include amounts of alkali metal halides calculated to improve the freeze resistance of the combination, that is, to lower the freeze point beyond the level of a solution of potassium formate alone.

Suitable sources of supplemental heat are selected from the group consisting of: engine cooling; waste heat recovery from power generation facilities and/or electrical heating from excess power from the power generation facilities; an exhaust gas heater; an electric water or fluid heater; a fired heater; a propulsion unit of the ship (when the regasification facility is onboard an LNGC); a diesel engine; or a gas turbine propulsion plant.

Examples of suitable cryogenic send-out pumps include a centrifugal pump, a positive-displacement pumps, a screw pump, a velocity-head pump, a rotary pump, a gear pump, a plunger pump, a piston pump, a vane pump, a radial-plunger pumps, a swash-plate pump, a smooth flow pump, a pulsating flow pump, or other pumps that meet the discharge head and flow rate requirements of the vaporizers. The capacity of the pump is selected based upon the type and quantity of vaporizers installed, the surface area and efficiency of the vaporizers and the degree of redundancy desired.

Now that several embodiments of the invention have been described in detail, it will be apparent to persons skilled in the relevant art that numerous variations and modifications can be made without departing from the basic inventive concepts. For example, whilst only one vaporizer 18 and only one ambient air heater 20 are shown in FIGS. 1 and 2 for illustrative purposes, it is to be understood that the regasification facility may comprise any number of vaporizers and heaters arranged in parallel or series depending on the capacity of each vaporizer and the quantity of LNG being regasified. When regasification is conducted onboard an LNG Carrier, the vaporizers, heaters and fans (if used) are designed to withstand the structural loads associated with being disposed on the deck of a vessel during transit of the vessel at sea including the loads associated with motions and possibly green water loads as well as the loads experienced whilst the vessel is moored offshore during regasification. The forced draft fan 46 can be positioned to one side of the ambient air heater 20 such that the ambient air heater 20 lies between the ambient air vaporizer 18 in a side-by-side arrangement instead of the vertical arrangement described above. All such modifications and variations are considered to be within the scope of the present invention, the nature of which is to be determined from the foregoing description and the appended claims.

All of the patents cited in this specification, are herein incorporated by reference.

It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed:

1. A process for regasification of LNG to form natural gas using ambient air as a primary source of heat, said process comprising:

(a) directing LNG to flow through an ambient air vaporizer to form a natural gas stream through heat exchange between the LNG and ambient air;

(b) adjusting the temperature of the natural gas stream to a predetermined delivery temperature in a trim heater by exchanging heat with a circulating intermediate fluid, wherein the trim heater is separate from the ambient air vaporizer such that the natural gas stream exits the ambient air vaporizer prior to entering and being treated in the trim heater;

(c) directing the intermediate fluid to flow through an ambient air heater such that the intermediate fluid exchanges heat with ambient air; and, (d) assisting heat transfer using one or more force draft fans to direct the flow of ambient air over the ambient air heater and the ambient air vaporizer, the ambient air heater being arranged in closer proximity to the forced draft fans than the ambient air vaporizer such that the air is directed to flow across the ambient air heater to cool and dry the air before the air arrives at the ambient air vaporizer.

2. The process of claim 1, wherein the one or more forced draft fans are installed above the ambient air heater which in turn is installed above the ambient air vaporizer and the air is caused to flow downwardly across the ambient air heater before arriving at the ambient air vaporizer.

3. The process of claim 1, wherein the ambient air heater and the ambient air vaporizer are arranged as a single system and share a common forced draft fan.

4. The process of claim 1, wherein a temperature of the intermediate fluid is maintained above zero degrees Celsius and the ambient air heater comprises a horizontal tube bundle.

5. The process of claim 1, wherein the ambient air heater comprises a horizontal tube bundle and the ambient air vaporizer comprises a vertical tube bundle.

6. The process of claim 4, wherein the temperature of the intermediate fluid is maintained above zero degrees Celcius using a source of supplemental heat.

7. The process of claim 6, wherein the source of supplemental heat is selected from the group consisting of an exhaust gas heater, an electric water or fluid heater, a propulsion unit of a ship, a diesel engine, a gas turbine propulsion plant, and an exhaust gas stream from a power generation plant.

8. The process of claim 1, further comprising directing a bypass stream of LNG to flow through an intermediate fluid vaporizer wherein the LNG exchanges heat with a portion of the circulating intermediate fluid.

9. The process of claim 1, wherein the intermediate fluid is selected from the group consisting of a glycol, a glycol-water mixture, methanol, propanol, propane, butane, ammonia, a formate, fresh water, and tempered water.

10. A regasification facility for regasification of LNG to form natural gas using ambient air as a primary source of heat, said apparatus comprising:

an ambient air vaporizer to regasify LNG to natural gas;

a trim heater to boost the temperature of the natural gas by exchanging heat with a circulating intermediate fluid, wherein the trim heater is separate from the ambient air vaporizer such that the natural gas stream exits the ambient air vaporizer prior to entering and being treated in the trim heater;

an ambient air heater to heat the intermediate fluid;

a circulating pump to circulate the intermediate fluid between the trim heater and the ambient air heater; and one or more forced draft fans to direct the flow of ambient air over the ambient air heater and the ambient air vaporizer, the ambient air heater being arranged in closer proximity to the forced draft fans than the ambient air vaporizer such that the air is directed to flow across the ambient air heater to cool and dry the air before the air arrives at the ambient air vaporizer.

11. The apparatus of claim 10, wherein the ambient air heater is installed above the ambient air vaporizer in closer proximity to the forced draft fans such that the air is caused to flow downwardly across the ambient air heater before arriving at the ambient air vaporizer.

12. The apparatus of claim 10, wherein the ambient air heater comprises a horizontal tube bundle and the ambient air vaporizer comprises a vertical tube bundle.

13. The apparatus of claim 10, wherein the ambient air heater comprises a horizontal tube bundle, and the apparatus further comprises a control device to regulate a temperature of the intermediate fluid fed to the ambient air heater to a temperature greater than zero degrees Celsius using a source of supplemental heat.

14. The apparatus of claim 13, wherein the source of supplemental heat is selected from the group consisting of an exhaust gas heater, an electric water or fluid heater, a propulsion unit of a ship, a fired heater, a diesel engine, a gas turbine propulsion plant, and an exhaust gas stream from a power generation plant.

15. The apparatus of claim 13, wherein the regasification facility is provided onboard an LNG carrier and the source of supplementary heat is heat recovered from the engines of the LNG carrier.

16. The apparatus of claim 10, further comprising an intermediate fluid vaporizer to vaporize a bypass stream of LNG, wherein the LNG exchanges heat with a portion of the circulating intermediate fluid.

17. The method of claim 1, wherein conversion of LNG to natural gas in the ambient air vaporizer is performed utilizing only ambient air and without any intermediate fluid.

18. The apparatus of claim 10, wherein the ambient air vaporizer regasifies LNG to natural gas utilizing only ambient air and without any intermediate fluid.

* * * * *